United States Patent [19]

Selvi

[11] Patent Number: 4,519,327

[45] Date of Patent: May 28, 1985

[54] TRANSFER MACHINE FOR OVERTURNING A TEXTILE TUBULAR ELEMENT FOR THE SEWING OF THE EDGES THEREOF AND FOR THE SUBSEQUENT RE-OVERTURNING AND DISCHARGING

[76] Inventor: Fabio Selvi, Via Delle Massucce 12, 50020 La Romola (Firenze), Italy

[21] Appl. No.: 588,249

[22] Filed: Mar. 12, 1984

[30] Foreign Application Priority Data

Mar. 11, 1983 [IT] Italy ..... 20035 A/83

[51] Int. Cl.[3] ..... D05B 21/00

[52] U.S. Cl. ..... 112/121.15

[58] Field of Search ..... 112/121.15, 121.11, 112/121.12, 303, 121.29; 223/43

[56] References Cited

U.S. PATENT DOCUMENTS

| | | | |
|---|---|---|---|
| 4,133,277 | 1/1979 | Arthur et al. | 112/121.15 |
| 4,188,898 | 2/1980 | Bell, Jr. et al. | 112/121.15 X |
| 4,220,104 | 9/1980 | Humphreys | 112/121.15 X |
| 4,364,320 | 12/1982 | Nakhle et al. | 112/121.15 X |
| 4,383,491 | 5/1983 | Hodges | 112/121.15 X |
| 4,410,171 | 10/1983 | Kobayashi | 112/121.15 X |

FOREIGN PATENT DOCUMENTS

| | | | |
|---|---|---|---|
| 1485277 | 9/1972 | Fed. Rep. of Germany | 112/121.15 |
| 2901267 | 8/1979 | Fed. Rep. of Germany | 112/121.15 |

*Primary Examiner*—H. Hampton Hunter

*Attorney, Agent, or Firm*—Oblon, Fisher, Spivak, McClelland and Maier

[57] ABSTRACT

The transfer machine is of the type comprising a plurality of hollow shaped bodies having substantially elliptical cross-section and a lower and upper edges, and drive means for the intermittent unidirectional advancement of said bodies along a predetermined path, to each dwell of a considered body corresponding a station.

According to the invention, a first of said stations is a threading station for the threading on the outer surface of one considered body of a tubular element with an end portion thereof projecting beyond said lower edge; a second of said stations has tucking means disposed below said path for tucking said projecting portion about the lower edge of the considered body and gripping means disposed above said path and aligned with said tucking means for gripping the tucked end portion to overturn said tubular element; a third of said stations has levelling means disposed below said path for levelling the upper edges of the overturned tubular element; transfer and gripping means are disposed above said path and moves along with a considered body and associated overturned tubular element from said second station to said third station and from there to a fourth of said stations which has conventional sewing means; and a fifth of said stations has means for re-overturning said overturned tubular element and for removing it from said considered body.

7 Claims, 11 Drawing Figures

TRANSFER MACHINE FOR OVERTURNING A TEXTILE TUBULAR ELEMENT FOR THE SEWING OF THE EDGES THEREOF AND FOR THE SUBSEQUENT RE-OVERTURNING AND DISCHARGING

BACKGROUND OF THE INVENTION

The present invention relates to a transfer machine for overturning a textile tubular element for the sewing of the edges thereof and for the subsequent re-overturning and discharging.

In the stocking and sock manufacture it is known to use a woven textile element having one end which is reinforced and/or provided with an elastic band while the other end is to be sewn to make up the pointed end of the stocking and/or sock.

According to the present technique, the textile elements are directly positioned on mechanical elements of the sewing machine and the overturning of said elements for the sewing of the edges thereof and the subsequent re-overturning and discharging and carried manually.

SUMMARY OF THE INVENTION

The object of the present invention is to provide a machine which avoids the drawbacks of the conventional tecnique.

The machine of the present invention is of the type comprising a plurality of hollow shaped bodies having substantially elliptical cross-section and a lower and an upper edges, and drive means for the intermittente and undirectional advancement of said bodies along a predetermined path to each dwell of a considered body corresponding a station and is characterised in that a first of said stations is a threading station for the threading on the outer surface of one considered body of a tubular element with an end portion thereof projecting beyond said lower edge; a second of said stations having tucking means disposed below said path for tucking said projecting portion about the lower edge of the considered body and gripping means disposed above said path and aligned with said tucking means for gripping the tucked end portion to overturn said tubular element; a third of said stations having levelling means disposed below said path for levelling the upper edges of said overturned tubular element; transfer and gripping means disposed above said path moving along with a considered body and associated overturned tubular element from said second station to said third station and from there to a fourth of said stations having conventional sewing means; and a fifth of said stations having means for re-overturning said overturned tubular element and for removing it from said considered body.

The novel features which are considered as characteristic of the invention are set forth in particular in the appended claims. The machine itself, however, both as its construction and its mode of operation, together with additional features and advantages thereof, will be best understood upon perusal of the detailed description of a preferred embodiment with reference to the accompanying drawings.

DESCRIPTION ON THE PREFERRED EMBODIMENT

Figure 1:
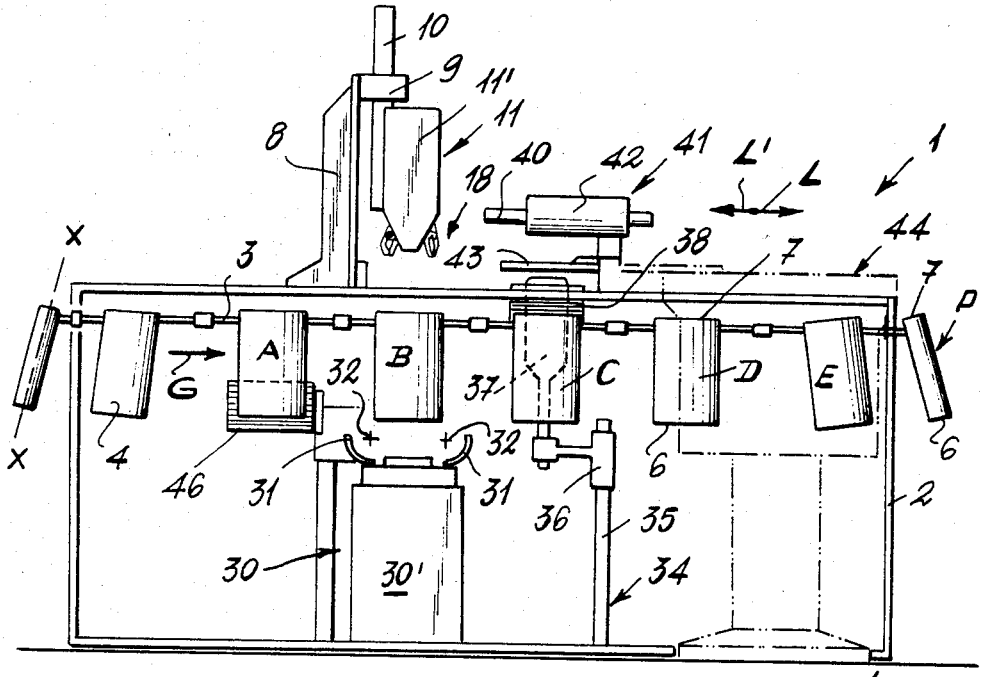
FIG. 1 is fragmentary diagrammatic side elevation of the machine.

Referring to the figures, the machine—generally denoted at 1—comprises a supporting frame 2 for a chain 3 intermittently driven at constant rate (arrow G) by conventional drive mean, not shown. The path of said chain 3 comprise two parallel rectilinear runs 3', 3'' and two semicircular runs at chain wheels, not shown.

The chain 3 has a plurality of equispaced shaped bodies 4 mounted thereon, and each forming support member for a woven tubular element 5.

Each body 4 comprises a hollow shell of substantially elliptical cross-section with a lower edge 6 and an upper edge 7, the latter provided with an extension 7' comprising the attachment element for the body 4 to the chain 3 with axis x—x inclined to the vertical.

Along the run 3' the frame 2 has an upright 8 mounted thereon and provided with a cross extension 9 for sustaining a vertically sliding shaft 10 carrying a gripping unit, generally denoted at 11. The drive of the shaft 10 is controlled by conventional means (not shown), for example pneumatic means.

Figure 3:
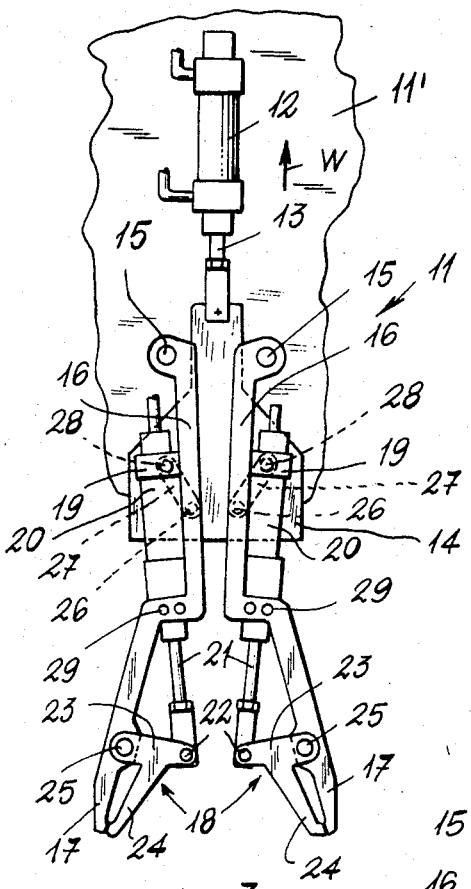
FIG. 3 is a detailed front view showing the gripping unit with closed jaws and closely spaced apart pliers.
Figure 4:
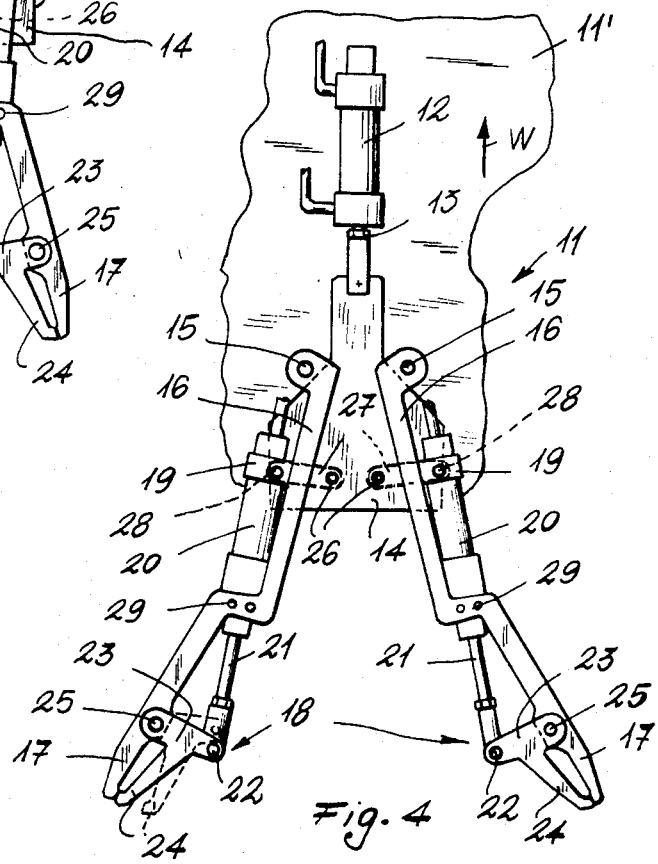
FIG. 4 is a view similar to FIG. 3, but with spread apart pliers.

As particularly shown in FIGS. 3 and 4, the gripping unit 11 comprises a first plate 11' integrally carrying a pneumatic cylinder 12 the stem 13 of which carries a second plate 14. The first plate 11' is provided with a pair of pins 15 each forming a pivot for one end of a lever 16 of a pair of levers, and the other end of each lever 16 comprises a fixed jaw 17. A pair of pneumatic cylinders 20 are pivoted to the plate 11' each through a collar 19 and the stem 21 of said cylinders 20 each has an element 23 pivoted at 22 and provided with an extension 24 comprising the movable jaw of pliers, generally denoted at 18, the element 23 being pivoted at 25 to the respective lever 16 adjacent the fixed jaw 17. On the back of the plate 14 there is provided a pair of links 27 each having one end pivoted at 26 to said plate 14 and the other end pivoted at 28 to the pivoting point of the collar 19 of the associated cylinder 20. Each lever 16 is secured at 29 to the associated cylinder 20.

Figure 2:
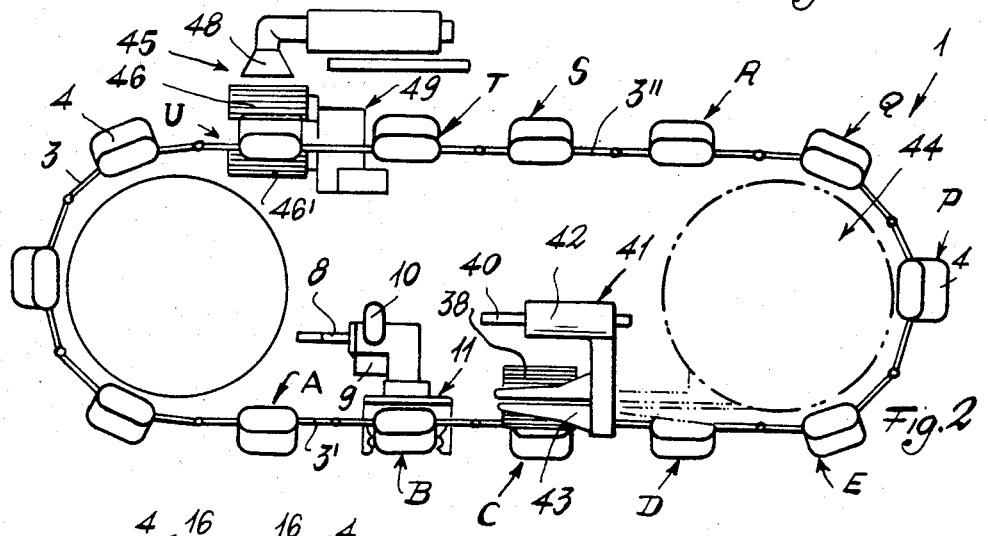
FIG. 2 is a top view of the machine of FIG. 1.
Figure 5:
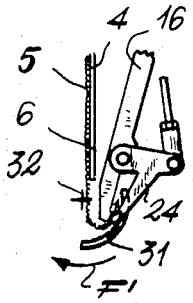
FIGS. 5 and 5*a* are views particularly showing the tucking unit at two different operative steps.
Figure 5A:
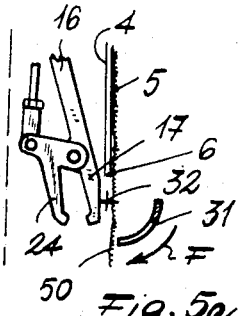

As shown in FIGS. 1 and 2, aligned with the gripping unit 11, below the run 3' of the chain 3, there is provided a tucking unit, generally denoted at 30. Said tucking unit 30 is supported by a base member 30' and comprises a pair of mechanical fingers 31 provided with reciprocating rotary motion (arrows F and F', FIGS. 5 and 5*a*) about axes 32 and controlled by conventional drive means, not shown. Each of said mechanical finger 31 has a recess 33 (FIG. 6) the function of which will be hereinafter described.

Figure 7:
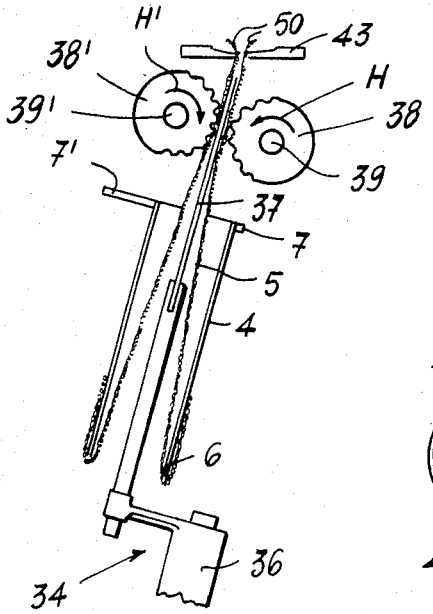
FIG. 7 is a view particularly showing the unit for levelling the edges to be sewn in the operative position.

As shown in FIG. 1, at a location downstream of the unit 30, below the chain 3, there is provided a closing unit, generally denoted at 34, comprising an upright 35 along which a sleeve 36 is slidably driven by conventional means, not shown, said sleeve carrying a thin blade 37 lying in the major median plane of the bodies 4. At the same level of the upper edges 7 of the bodies 4, externally to the same, a pair of knurled rollers 38, 38' (FIG. 7) is provided, the roller 38 being rotatably driven in the direction of the arrow H about a fixed axis 39 parallel to the run 3' while the roller 38' is rotatably driven in the direction of the arrow H' about an axis 39', parallel to the fixed axis 39 and movable relative thereto to bring the relative roller 38' from a position spaced apart from the opposite roller 38 to a positive closed to said roller 38, and viceversa. The to and away movement drive is controlled by conventional means, not shown.

Above the run 3' of the chain 3 (FIGS. 1 and 2) and carried by the frame 2 a guide 40 is provided for the sliding of a transfer unit, generally denoted at 41, comprising a sleeve 42 carrying a pliers 43 the jaws of which form a crack of adjustable width arranged parallel to the run 3'. Conventional means, not shown, provides for the alternate displacement (arrows L and L', FIG. 1) of the unit 41 to bring said pliers 43 from a position aligned with the unit 30 to a position aligned with a conventional cutting and sewing machine (for example of the type disclosed in the Italian patent applications No. 691009 A/63 and No. 794931 A/63) shown by hatching in FIGS. 1 and 2 and generally denoted at 44.

Figure 8:
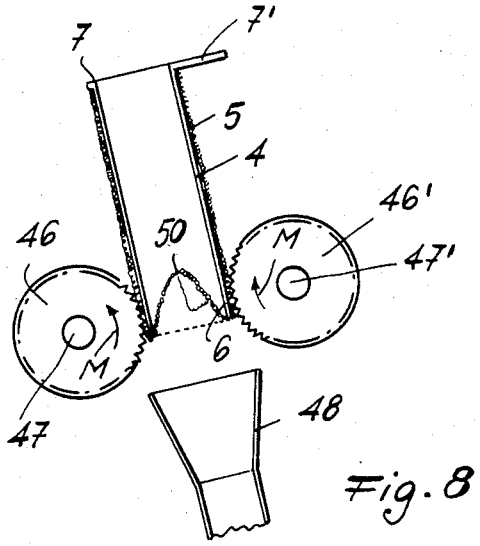
FIGS. 8 and 9 are views showing the discharging unit at two operative steps.
Figure 9:
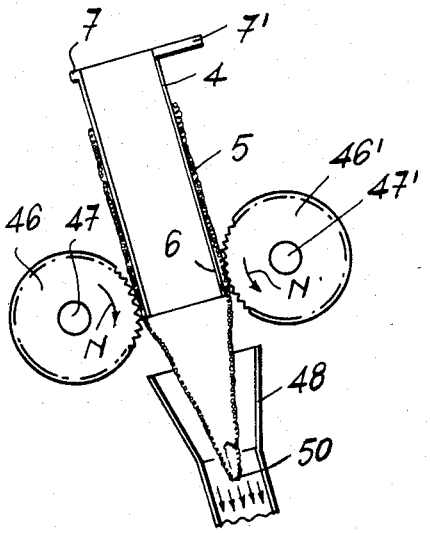

A discharging unit, generally denoted at 45 (FIG. 2), is provide along the run 3" of the chain 3, for discharging the completed stocking or similar articles from the bodies 4. Said unit 45 (FIGS. 8 and 9) comprises a pair of knurled rollers 46, 46' rotatably driven about axes 47, 47' parallel to the run 3", and a sucking mouth 48 located adjacent said rollers. The rollers 46, 46' are spaced from each other by a distance substantially corresponding to the length of the minor axis of the bodies 4 and rotatably driven in direction of the arrows M and N by drive means generally denoted at 49 in FIG. 2.

OPERATION

In operation, the position taken by the individual bodies 4 during each dwell of the chain 3 will be hereinafter referred to as a station, and for the sake of clarity the various operations in the involved station will be described with reference to only one of the various bodies 4, the same operations being substantially repeated for the other bodies carried by the chain 3.

A tubular textile element 5 is manually threaded on a body 4 dwelling at station A. This operation consists of fitting said element 5 on the outside of the involved body 4 by leaving a short length, denoted at 50 in FIG. 5*a*, of the end portion of the element 5 projecting beyond the lower edge 6 of the considered body 4.

Figure 6:
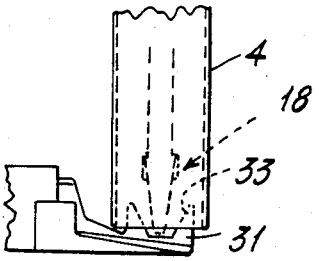
FIG. 6 is a fragmentary view of the mechanical fingers of the tucking unit.

The involved body 4 is moved forward (arrow G) by one step so as to pass from station A to station B to be aligned with the gripping unit 11 having, at this time, the pliers 18 in a lifted position and with closed jaws. Controlling means, synchronized with the chain 3, moves downwardly the pliers 18 so as to enter it inside the body 4, now stationary at the station B, and to step it near the lower edge 6 of the body 4. Through the stems 21 of the cylinders 20 the movable jaws 24 are opened relative to the associated fixed jaws 17. The mechanical fingers 31 are rotated in direction of the arrow F (FIG. 5*a*) so as to tuck the projecting length 50 of the member 5 about the lower edge 6 of the considered body and inside to the latter. Just before the backward movement (arrow F', FIG. 5*a*) of the mechanical fingers 31, the jaws 24 closes (FIG. 5) and grips the tucked length 50, this gripping operation being not hindered by the mechanical fingers 31 owing to the provision on the latter of the recess 33 (FIG. 6).

Figure 10:
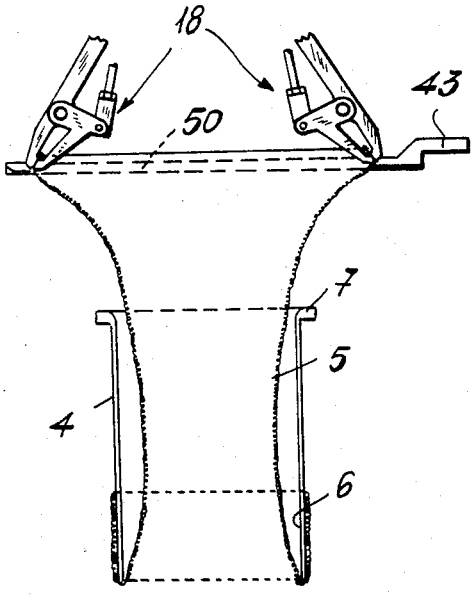
FIG. 10 is a view showing the gripping unit with pliers in gripping condition and spread apart during an operative step of the machine.

The shaft 10 is now moved upwardly again and at the end of its stroke the pliers 18 are spaced apart (FIGS. 4 and 10) due to displacement of the stem 13 in the direction of arrow W, FIGS. 3 and 4. The lifting of the pliers 18 causes the tubular element 5 to slide along the interior of the body 4 with resulting overturning of said tubular element, as shown in FIG. 10, where the pliers 18 are shown at a spread condition as also shown also in FIG. 4. The spreading of the pliers 18 causes a crack closing of the end edge of the length 50 of the tubular element 5.

As a result of the displacement of the unit 41 in the direction of the arrow L' from station C to station B, the pliers 43 engages with the crack closed portion of the end edge of the length 50, maintaining the latter in place owing to the previous clamping adjustment of the pliers 43 in accordance with the type of fabric comprising the element 5. The unit 41 is now operated to move in the direction of the arrow L along with the involved body 4 so as to be transferred from station B again to station C.

During the dwell of the involved body 4 at the station C and with the length 50 still retained by the pliers 43, the unit 34 is operated. The blade 37 is introduced from below (FIG. 7) into the tubular element 5 until it is positioned between the rollers 38, 38' with roller 38' spaced apart relative to the opposite fixed roller 38. The roller 38' is now moved to press against the opposite roller 38 with the blade 37 interposed therebetween. The rollers 38 and 38' are rotated in the direction of the arrow H and H' for correctly levelling the opposite edges of the length 50. Suitable friction means, not shown, stops the rotation of either roller or both rollers when the resistance of the tubular element 5 sliding between the jaws of the pliers 43 exceeds a predetermined value. The blade 37 is now moved downwardly and the unit 41 with the pliers 43 still in engagement with the length 50 moves along with the involved body 4 (arrow L) from station C to the next station D, where conventional means transfer said length 50 to the inside of the guides (not shown) of the cutting and sewing machine 44.

At subsequent stations E, P, Q, R, S and T the tubular element 5 is subjected to conventional further operations for sewing.

At station U (FIGS. 8 and 9) the rollers 46 and 46' engage the parallel sides of the involved body 4 and, by rotating in the direction of the arrow M, remove the element 5 from the inside of the same body 4 and thread in again on the outside of the same body 4. When the sewn part 50 reaches the lower edge of the body 4 (FIG. 8) the rollers 46 and 46' are rotated in the direction of the arrow N (FIG. 9) so as to unthread the element 5 from the body 4 and said element can now be sucked by the mouth 48 and supplied to a collecting zone.

From the foregoing it clearly appears that the only manual operation to be carried out is to thread the tubular elements 5 on the bodies 4 at the loading station A, the overturning of said tubular elements automatically occurring at the station B, the correct levelling of the edges to be sewn also automatically occurring at the station C, the sewing at station D and the discharging of the elements automatically occurring at the station U.

Without further analysis, the foregoing will so fully reveal the gist of the present invention that others can, by applying current knowledge, readily adapt it for various applications without omitting features which fairly constitute essential characterstics of the generic and specific aspects of my contribution to the art and, therefore, such adaptations should and are intended to be comprehended within the meaning and range of equivalence to the claims.

What I claim is:

1. A transfer machine for overturning a textile tubular element for the sewing of the edges thereof and for the subsequent re-overturning and discharging comprising:

a plurality of hollow shaped bodies having substantially elliptical cross-section and a lower and an upper edge;

drive means for the intermittent and unidirectional advancement of said bodies along a predetermined path, to each dwell of a considered body corresponding a station;

a first of said stations being a station for the threading on the outer surface of on considered body of a tubular element with an end portion thereof projecting beyond said lower edge;

a second of said stations having tucking means disposed below said path for tucking said projecting portion about the lower edge of the considered body and gripping means disposed above said path and aligned with said tucking means for gripping the tucked end portion to overturn said tubular element;

a third of said stations having levelling means disposed below said path for levelling the upper edges of said overturned tubular element;

transfer and gripping means disposed above said path moving along with a considered body and associated overturned tubular element from said second to said third station and from there to a fourth station having conventional sewing means; and a fifth of said stations having means for re-overturning said overturned tubular elements and for removing it from said considered body.

2. A transfer machine according to claim 1, wherein said tucking means comprises a pair of mechanical fingers provided with rotary reciprocating motion, said mechanical fingers being arranged adjacent the lower edge of the considered body.

3. A transfer machine according to claim 1, wherein said gripping means comprises a pair of pliers means and means for moving said pair of pliers means from a first position external to said considered body to a second position internal to the same considered body close to said tucking means and viceversa, means for closing and opening said pliers means when in said second position and means for spreading apart said pair of pliers when in said first position, said transfer and gripping means being disposed substantially at the same level of said pair of pliers means when the latter are at said first position.

4. A transfer machine according to claim 1, wherein said levelling means comprises a blade element and a pair of opposed rollers disposed above the upper edge of the considered body and below of said transfer and gripping means, said rollers being driven in counter-rotation.

5. A transfer machine according to claim 4, wherein said rollers are knurled rollers and one roller of the pair is movable to and away from the opposite roller.

6. A transfer machine according to claim 1, wherein said transfer and gripping means comprises pliers means having fixed jaws, but of adjustable opening, parallel to said path.

7. A transfer machine according to claim 1, wherein said re-overturning and removing means comprises a pair of opposed knurled rollers engaging the considered body and the associated tubular element, means being provided for rotating said rollers in a first and a second direction respectively for re-overturning said tubular element and for removing it from the associated body and tucking means disposed below said pair of rollers.

* * * * *